US005960604A

United States Patent [19]

Blanton

[11] Patent Number: 5,960,604

[45] Date of Patent: Oct. 5, 1999

[54] INTERLOCKING MASONRY UNIT AND WALL

[76] Inventor: C. Kenneth Blanton, 507 Charlestown Ave., Jeffersonville, Ind. 47130

[21] Appl. No.: 08/970,795

[22] Filed: Nov. 14, 1997

[51] Int. Cl.[6] ..... E04C 2/04

[52] U.S. Cl. ..... 52/604; 52/605; 52/592.6; 52/592.5; 52/590.2; 52/591.1; 52/596

[58] Field of Search ..... 52/603, 604, 605, 52/589.1, 592.6, 592.1, 592.4, 592.5, 590.2, 591.1, 591.2, 596, 598, 284, 599

[56] References Cited

U.S. PATENT DOCUMENTS

| | | |
|---|---|---|
| 2,198,011 | 4/1940 | Muirhead . |
| 2,792,704 | 5/1957 | Kooiman . |
| 2,911,818 | 11/1959 | Smith . |
| 3,290,849 | 12/1966 | Wright . |
| 3,299,599 | 1/1967 | Zachar . |
| 3,478,482 | 11/1969 | Weir . |
| 3,557,505 | 1/1971 | Kaul . |
| 3,818,656 | 6/1974 | Vigliotti . |
| 3,924,056 | 12/1975 | LoCicero . |
| 4,031,678 | 6/1977 | Schuring . |
| 4,172,344 | 10/1979 | Childress, Jr. et al. . |
| 4,182,089 | 1/1980 | Cook . |
| 4,473,985 | 10/1984 | Hunt . |
| 4,573,301 | 3/1986 | Wilkinson . |
| 4,597,236 | 7/1986 | Braxton . |
| 4,651,485 | 3/1987 | Osborne . |
| 5,181,362 | 1/1993 | Benitez . |
| 5,402,609 | 4/1995 | Kelley, Jr. . |
| 5,457,926 | 10/1995 | Jensen . |

*Primary Examiner*—Christopher T. Kent
*Assistant Examiner*—Yvonne Horton-Richardson
*Attorney, Agent, or Firm*—Theresa Fritz Camoriano; Camoriano & Associates

[57] ABSTRACT

Blocks are provided which can be assembled to form a wall without the use of skilled labor. The blocks are assembled with an adhesive caulk, which forms a watertight gasket around the wall. This design can withstand winds and earthquakes better than a standard block wall. The standard block includes a rectangular block portion, a rear face portion, and a front face portion. The face portions are recessed from the top surface of the rectangular block portion and project down from the bottom surface of the rectangular block portion. Of course, the use of the terms bottom and top are relative, and the wall could be assembled with all the blocks upside-down.

9 Claims, 8 Drawing Sheets

INTERLOCKING MASONRY UNIT AND WALL

BACKGROUND OF THE INVENTION

The present invention relates to blocks used in the construction industry. More particularly, the present invention relates to interlocking masonry blocks that are used in the construction of structural and curtain walls.

Masonry blocks are commonly used in wall construction because of their strength and superior weather resistance. However, construction of such walls can be labor intensive and time-consuming. In addition, the type of labor required to build a standard block or brick wall is skilled labor, which is expensive. Typically, blocks are laid in a row, and mortar is manually applied to the top surface of each row of blocks and between the individual blocks in a row. A second row of blocks is then laid on top of the first row, and so forth. Forming walls in this manner requires skilled craftsmen to assure that the wall formed is horizontally and vertically true, and to assure that the wall has the required strength to support a roof or floor.

Many forms of interlocking blocks have been developed to try to make it easier to build a block wall, in order to reduce labor costs. Some of the blocks that have been developed are fastened together without the use of mortar. Commonly, these blocks have projections that mate with corresponding indentations on adjacent blocks. Many of these projections, however, are relatively small, and, thus, there is an inherent weakness in the block. Also, the use of small projections and small indentations means that the blocks have to be built to close tolerances, which makes the blocks expensive. The typical small projections may easily be broken or chipped off prior to or during construction, which means that many blocks are wasted, again adding to the expense.

SUMMARY OF THE INVENTION

The present invention is an interlocking masonry block system that can be used by a less skilled worker and that overcomes the described problems of prior art interlocking blocks. The present invention allows for the efficient, labor-saving construction of a masonry wall having a waterproof, aesthetically pleasing, permanent exterior and an interior that easily accommodates the installation of conventional drywall. The block system of the present invention also provides structural advantages that are not available in a standard block wall, including providing pathways to remove humidity and moisture from the wall and providing superior earthquake and hurricane resistance.

Each standard interlocking unit includes a substantially rectangular block having a front face that is recessed from the top surface of the rectangular block and that projects downwardly beyond the bottom surface of the rectangular block. The rear face is recessed from the top surface of the block and is also recessed from the right and left ends of the block. Thus, when the blocks are joined together, there is a locking ridge running transversely along the top surface of a row of adjoining blocks, and there is a locking channel running transversely along the bottom surface of the row of adjoining blocks. This results in a large interlocking surface that provides for more stable attachment to adjacent units. Also, when assembled, the walls define vertical channels for accommodating furring strips or other fastening strips or for providing a pathway to remove humidity or moisture.

DESCRIPTION OF THE PREFERRED EMBODIMENTS

Figure 1:
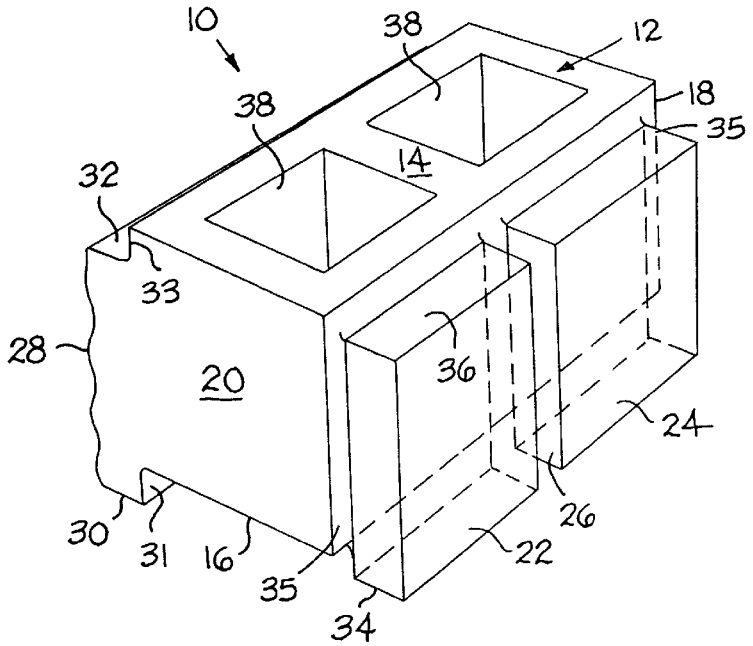
FIG. 1 is a rear perspective view of a standard building block made in accordance with the present invention.
Figure 2:
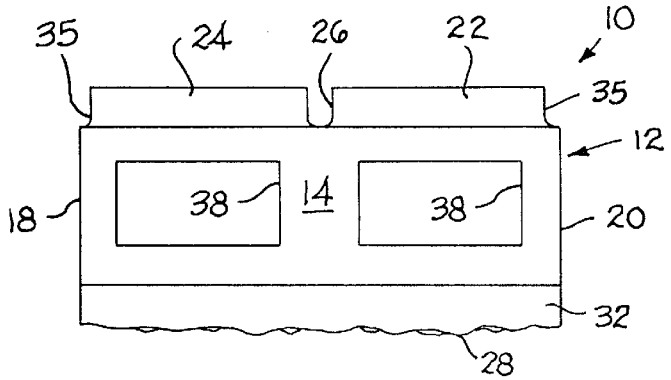
FIG. 2 is a top view of the block of FIG. 1.
Figure 3:
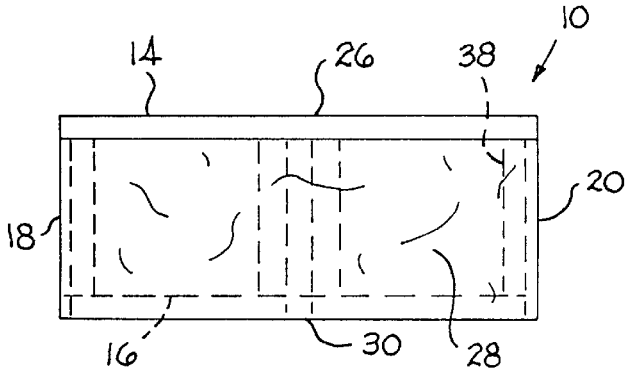
FIG. 3 is a front view of the block of FIG. 1.
Figure 4:
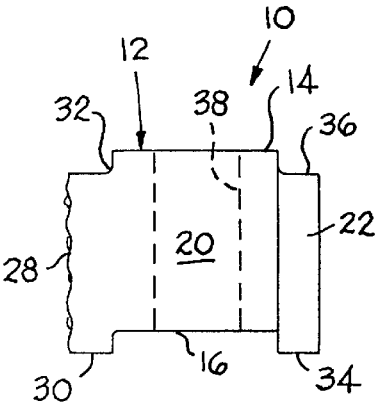
FIG. 4 is a right side view of the block of FIG. 1, which is a mirror image of the left side view thereof.

FIGS. 1–4 show a standard block 10 made in accordance with the present invention. The block 10 includes a substantially rectangular block portion 12, which is basically the same as regular concrete blocks. This rectangular block portion 12 includes a substantially flat top surface 14, a substantially flat bottom surface 16, a substantially flat left end 18, and a substantially flat right end 20. In addition to the standard rectangular block portion 12, there are two rear face portions 22, 24, which are integral with the rectangular block portion 12, and which are recessed from the top surface 14 of the rectangular block portion 12 and from the left and right ends 18, 20 of the rectangular block portion 12. The end recesses 35 of the rear face portions 22, 24 are the same width. The rear face portions 22, 24 also project downwardly beyond the bottom surface 16 of the rectangular block portion. There is a space or central vertical groove 26 defined between the two rear face portions 22, 24, which can receive wooden studs or can serve other functions, as will be described later. The block 10 also has a front face 28, which is recessed from the top surface 14 of the rectangular block portion 12 and which projects downwardly beyond the bottom surface 16 of the rectangular block portion 12 by a predetermined height. The front face 28 projects downwardly the same amount, or height, that it is recessed from the top surface, so that the projection 30 of one block 10 fits down into the recess 32 of the next lower block 10. The recess 32 forms an L-shaped cross-section, having a vertical back 33 that extends to the top surface 14 of the rectangular block 12; the projection 30, likewise forms an L-shaped cross-section, having a vertical back 31 that extends upward to the bottom surface 16. The same is true of the rear face portions 22, 24, which project downwardly the same amount that they are recessed at the top, so that the downward projection 34 on the back of one block 10 fits into the upper recess 36 of the next lower block. The front face 28 shown here is a split face, which is known in the industry and is generally more aesthetically pleasing than a standard flat face, but any type of face may be used, including a flat face, a face with horizontal and/or vertical grooves, and so forth. As with a normal concrete block, the block 10 defines two hollow, vertical cores 38, which reduce the weight of the blocks and reduce the amount of material needed to make the blocks from what would be required if the blocks were solid. The cores 38 also create a dead air space, which improves the insulation value of the blocks, and which may be filled with insulation.

Figure 5:
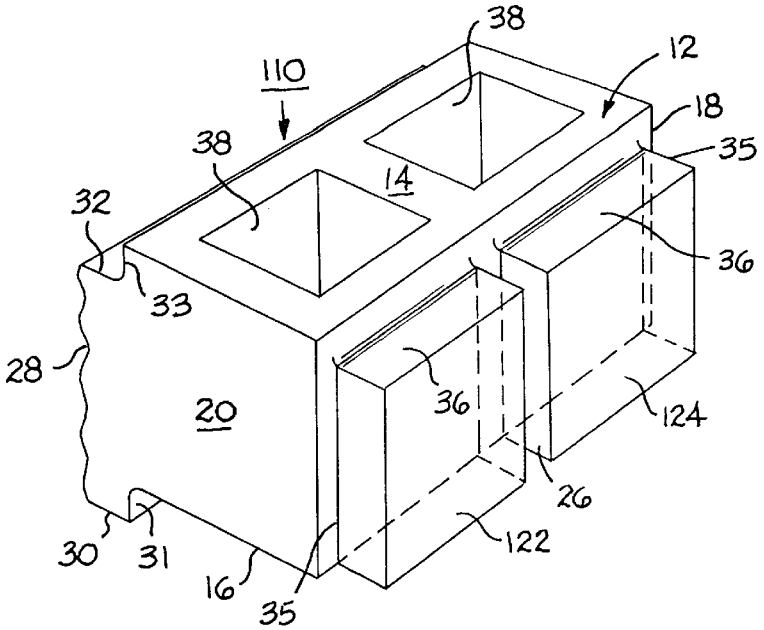
FIG. 5 is a rear perspective view of a horizontal groove-forming block made in accordance with the present invention.
Figure 6:
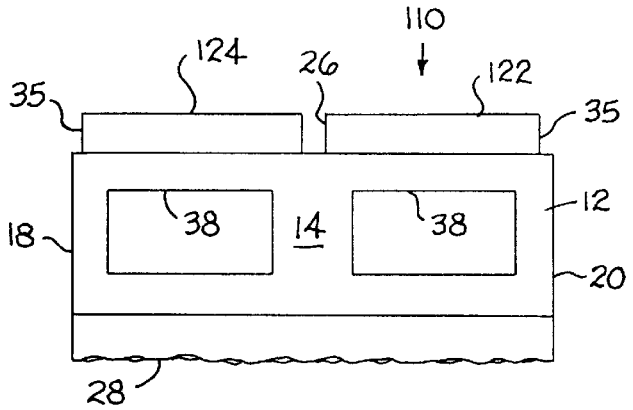
FIG. 6 is a top view of the block of FIG. 5.
Figure 7:
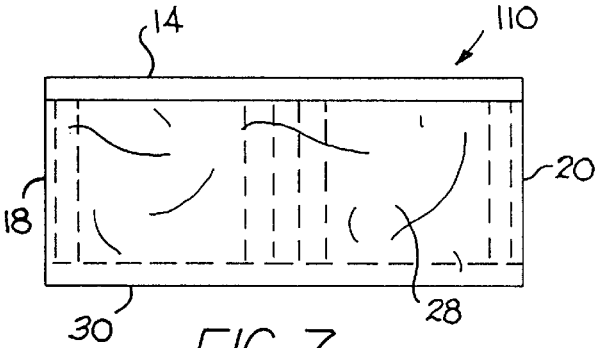
FIG. 7 is a front view of the block of FIG. 5.
Figure 8:
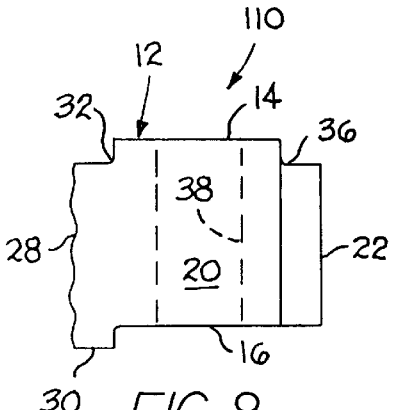
FIG. 8 is a right side view of the block of FIG. 5, which is a mirror image of the left side view thereof.
Figure 9:
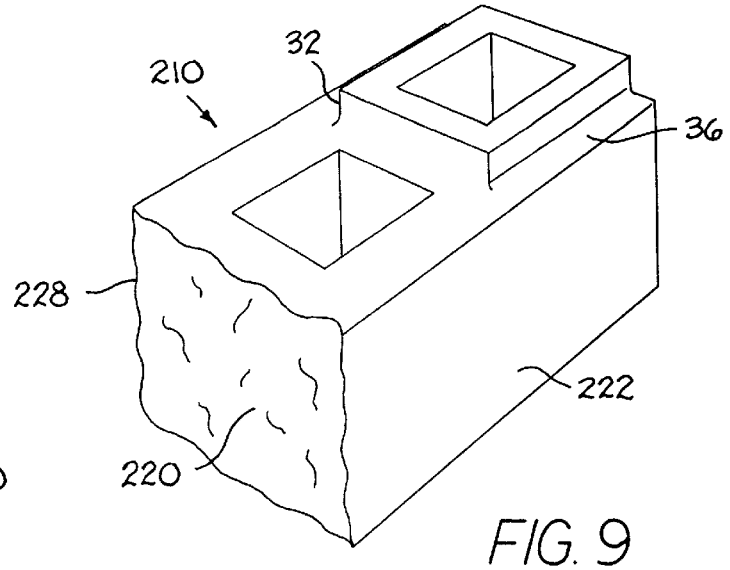
FIG. 9 is a rear perspective view of a corner block made in accordance with the present invention.
Figure 10:
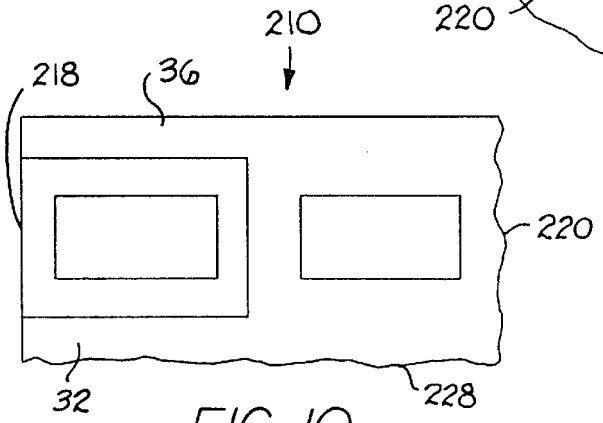
FIG. 10 is a top view of the block of FIG. 9.
Figure 11:
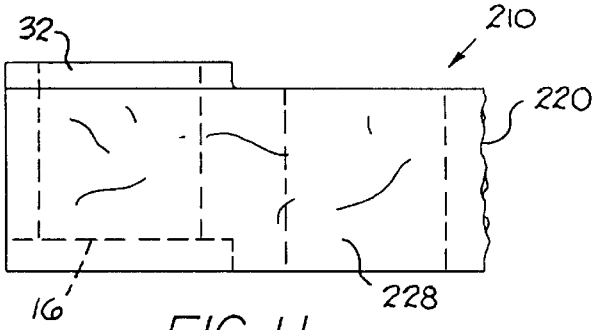
FIG. 11 is a front view of the block of FIG. 9.
Figure 12:
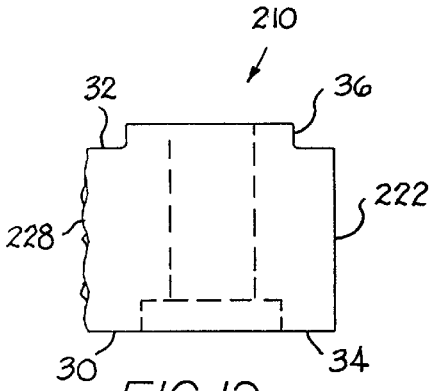
FIG. 12 is a right side view of the block of FIG. 9.
Figure 13:
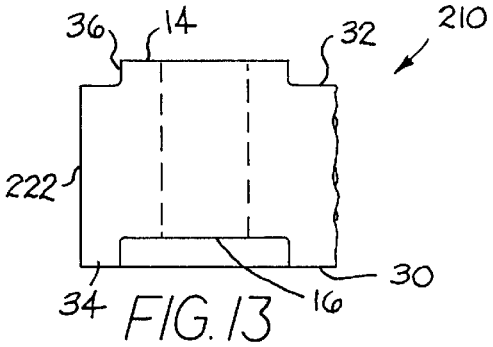
FIG. 13 is a left side view of the block of FIG. 9.

FIG. 5 shows a horizontal-groove-producing block 110, which has the same rectangular block portion 12 as the standard block 10 and the same front face 28. The only difference between this block 110 and the standard block 10 is that the rear face portions 122, 124 do not project down beyond the bottom surface 16 of the rectangular block portion 12. If these horizontal-groove-producing blocks 110 are used on top of themselves or on top of a standard block 10, they will produce a horizontal groove between the bottom surface of the rear face portions 122, 124 and the recessed top surfaces 36 on the rear faces 22, 24 or 122, 124 of the other blocks 10 or 110. This horizontal groove can be used to receive wiring or piping or to receive horizontal studs or other members. It is desirable, for example, to use a row of these horizontal-groove-producing blocks 110 at a height of about 18 inches from the floor, for running electrical wiring and setting electrical outlets.

A third type of block in accordance with the present invention is the corner block 210, shown in FIGS. 9–13, which only defines a top front recess 32 and a top rear recess 36 on one end. In addition, the corner block 210 has the decorative split front face 228 and a split face on one of its sides 220.

Figure 14:
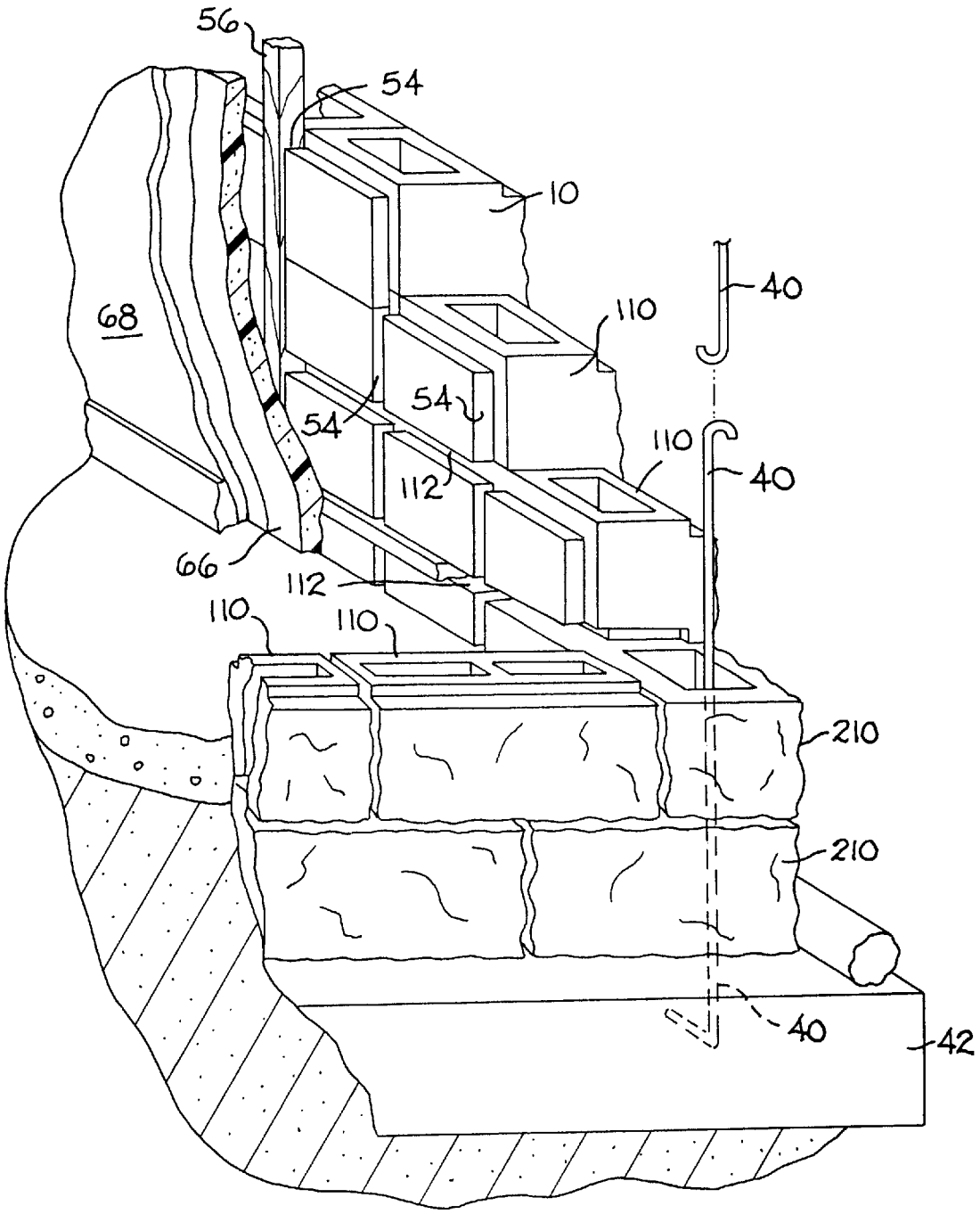
FIG. 14 is a schematic perspective view, partially broken away, of a wall made in accordance with the present invention.
Figure 15:
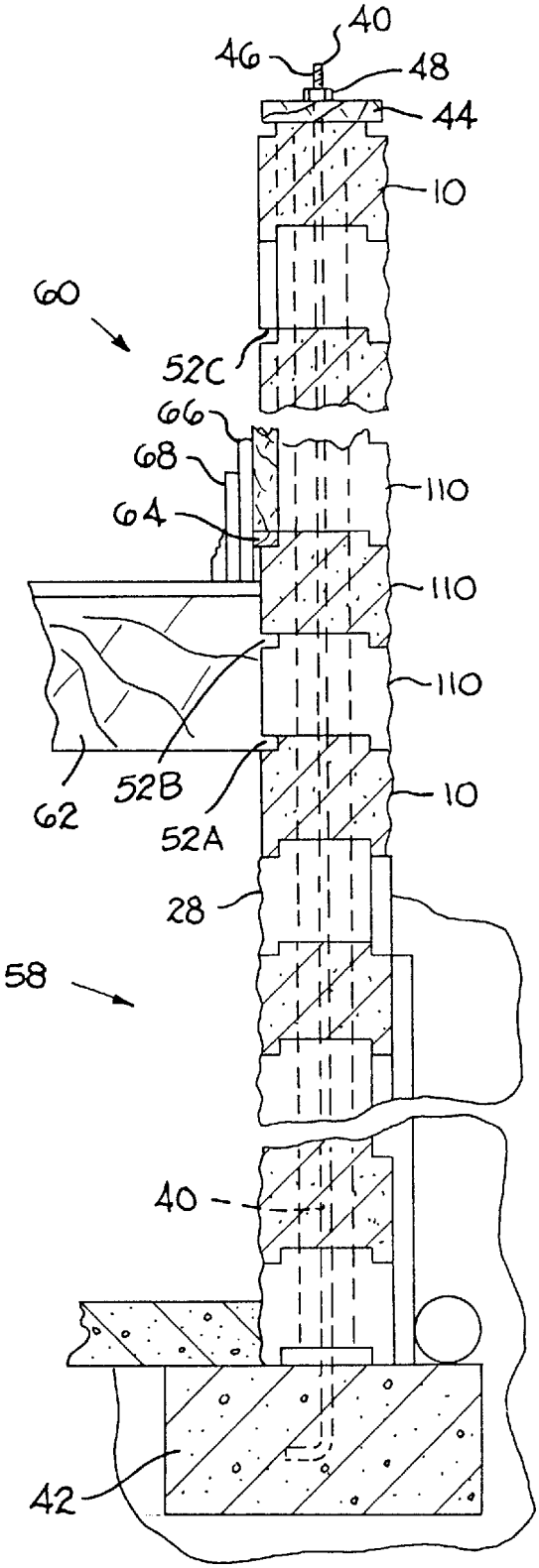
FIG. 15 is a schematic side sectional view of a wall made in accordance with the present invention.
Figure 16:
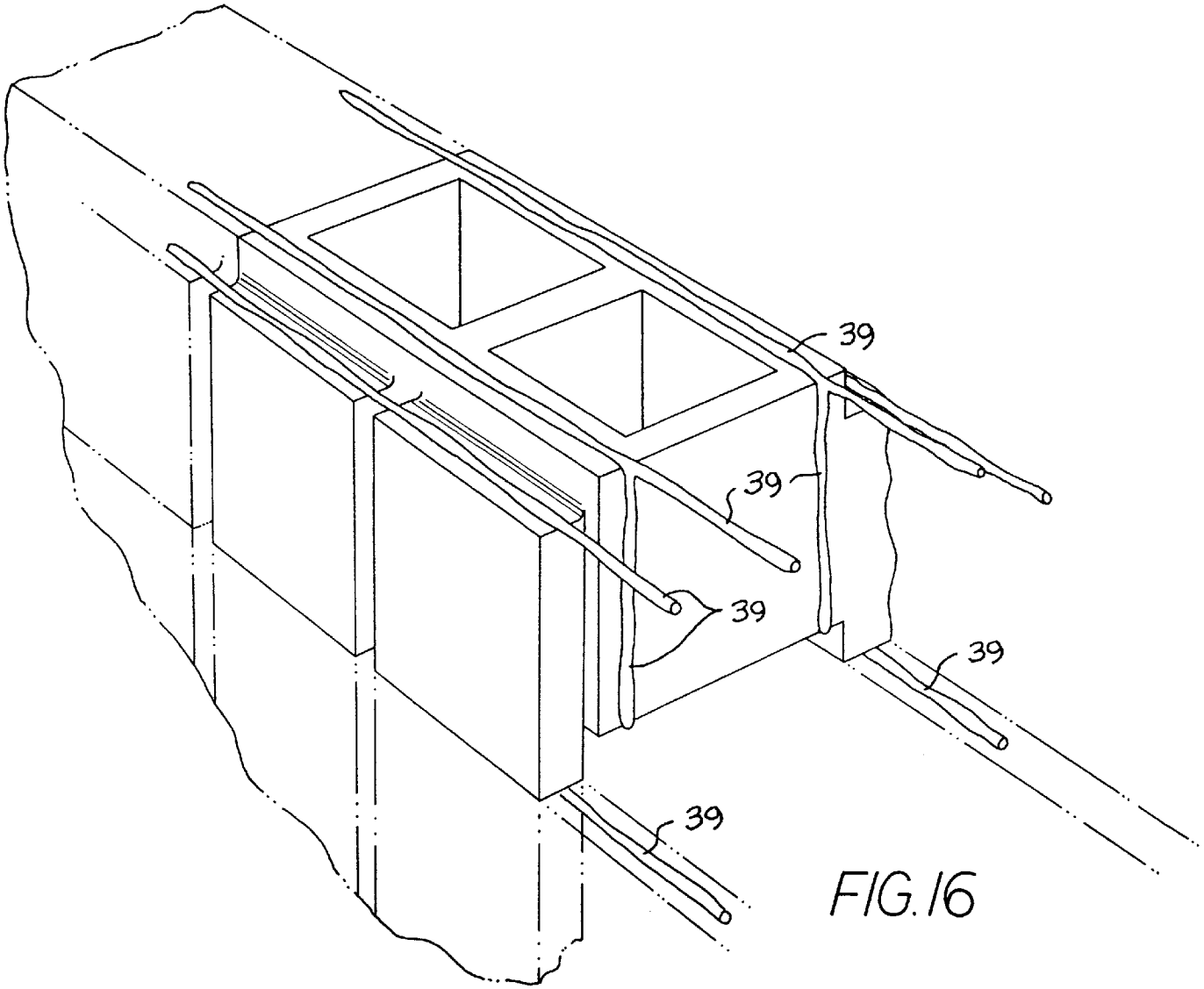
FIG. 16 is a schematic perspective view of a standard block, showing where the caulk is run between the blocks.
Figure 17:
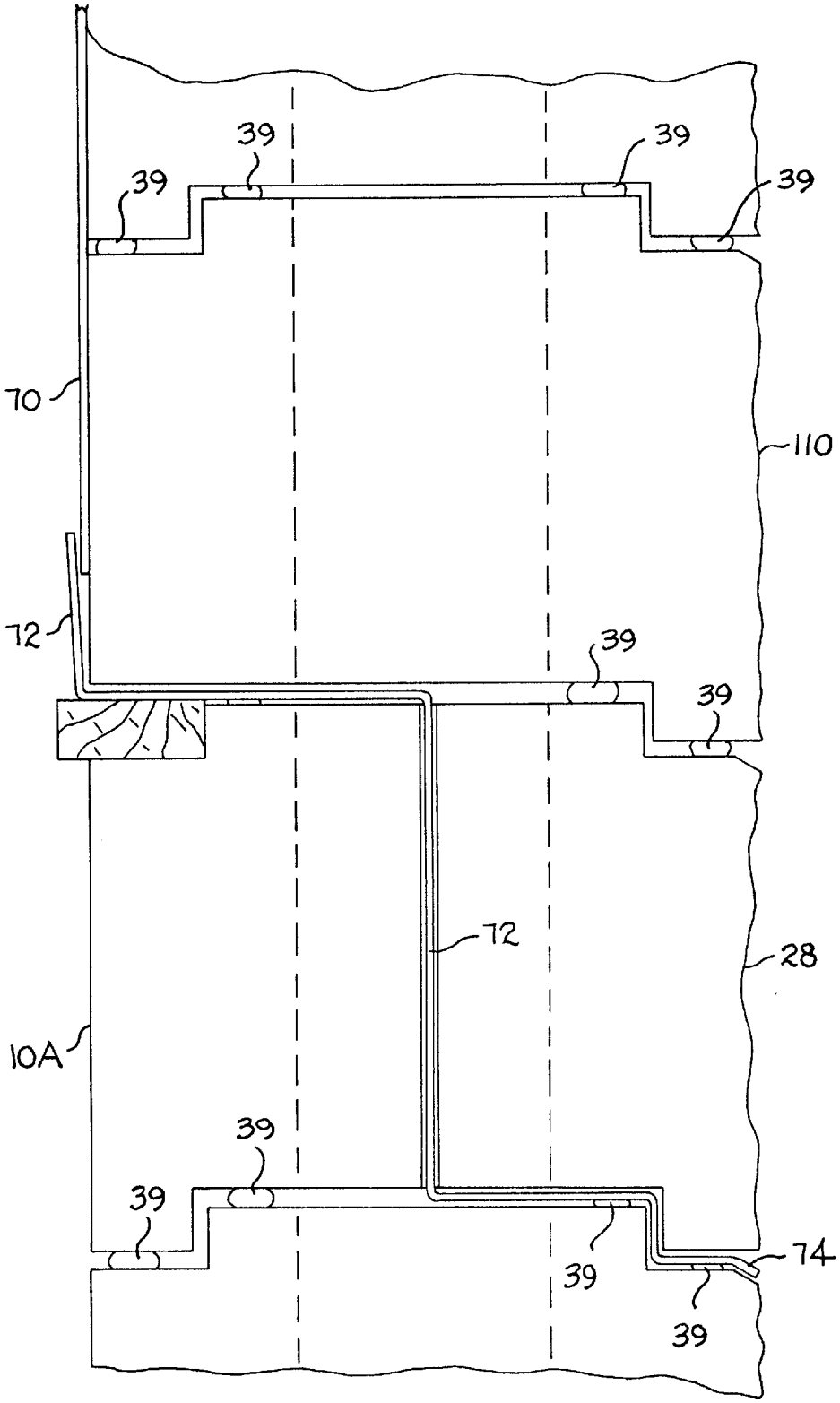
FIG. 17 is a schematic end view of a wall made of blocks of the present invention, showing the caulk and a path for removing moisture.

To build a wall from the blocks 10, 110, 210, as shown in FIGS. 14, 15, 16, or 17, the blocks are bonded together with a flexible waterproof adhesive, such as a caulk 39 manufactured by TREMCO under the trademark DyMonic. The flexible caulk 39 is placed on the adjacent bottom surfaces, top surfaces, and side surfaces and forms a gasket around the wall system, as shown in FIGS. 16 and 17. As shown in FIGS. 14 and 15, steel rebar 40 is embedded vertically in the conventional concrete footing 42 at corners and at a predetermined spacing (approximately every fourth block), to extend vertically through the hollow cores 38 to an anchoring plate 44 at the top of the wall or at an aperture opening. Several sections of rebar 40 may be connected together as shown in FIG. 14, to reach the top of the wall. The uppermost section of rebar 40 includes threads 46 and receives a nut 48, which is tightened in order to put the rebar 44 in tension, thus compressing the gaskets formed by the adhesive and putting the blocks 10, 110, 210 in compression.

Thus, in the event of lateral forces (earthquake or wind pressure), the flexible caulk gaskets 39 will accommodate movement within the wall system, between the tolerances of the interlocking projections 30, 34 and recesses 32, 36, without failure of the wall system. In conventional load bearing masonry wall systems, the mortar joints are expected to fail first in earthquakes and lateral force situations. The tensile strength of the rebar 40 and the compression on the wall system should leave far less or no damage to the bearing walls in such lateral force situations.

A conventional concrete footing 42 is used with conventional horizontal steel reinforcement. Care should be taken to leave a level surface. In the event the surface of the footing is not level, the first course of blocks should be a mortar course, attached and leveled at the foundation with conventional mortar. Once there is a level starting point, the blocks 10, 110, 210 can be installed with the flexible caulk adhesive, as follows.

At least two beads of caulk 39 are run transversely along the top of each course of units, taking care that the locations of the beads 39 are balanced so as to maintain the blocks in a horizontal position. The caulk is applied to the top surfaces and end surfaces of the blocks. The caulk 39 is applied with a caulking gun or other known dispensing device (not shown). Since the design of the blocks allows for minor variations in the blocks and makes the blocks self-leveling, skilled labor is not required to build the walls. Leveling lines do not have to be run every course, there is no mortar to be pointed, and uniform joints automatically occur and do not need to be built up.

As shown in FIG. 14, the corner blocks 210 are used at the corner, and then the standard blocks 10 or horizontal groove blocks 110 are used for the rest of the row. FIG. 14 also shows two horizontal grooves 112, which are formed by the horizontal-groove-producing blocks 110, and it shows vertical grooves 54, which are formed by the gaps 26 and the recesses 35 in the back portion of the blocks. Depending upon the size of the vertical grooves 54, they may receive 2×2's, 2×4's, or furring strips 56. Since the blocks are staggered, each vertical groove 54 is formed by a combination of the side recesses 35 and the spaces 26 formed by the rear face portions 22, 24, 122, 124.

It is not expected that every vertical groove 54 will receive a stud or furring strip 56 for attaching insulation or wallboard to the inside surface of the wall. The vertical grooves 54 that are not used for studs can be used to run piping or wiring or to provide a channel for moisture to be removed from the wall.

FIG. 15 shows how these blocks can be used for basement construction. In this figure is shown a sectional view of the basement 58 and first floor 60 of a wall constructed according to the present invention. The basement wall 58 is formed with the decorative front face 28 of the blocks 10 facing inwardly, so it is not necessary to add any wallboard or other wall covering in the basement 58. Then, the floor joists 62 are fastened to the wall at the horizontal grooves 52A, 52B, formed by two rows of horizontal groove-producing blocks 110. An additional horizontal groove 52C is located at the correct height for electrical outlets. Horizontal pieces of wood 64 may be placed in the horizontal grooves to provide something to which to fasten an outlet or a baseboard. Then, sheets of insulation 66 are fastened to the vertical boards, which are located in the vertical grooves 54, and then gypsum board 68 is fastened through the insulation into the vertical boards, forming the finished interior surface.

FIG. 17 shows a method for removing moisture from the wall. In this view, a membrane 70 is run along the entire rear surface of the block wall, creating a moisture barrier. At a lower point on the wall, a row of blocks 10A is split in half vertically from side to side, and a flashing 72 is installed, providing a downwardly-sloping path from the membrane 70 to the outside surface 28 of the wall. At intervals along the wall (preferably four-foot intervals), rope wicking 74 is inserted to help wick any moisture out, away from the wall. When installing the flashing and rope wicking 74, care must be taken to locate the caulk 39 so that it does not interfere with the flow of liquid along the top surface of the flashing 72, from the membrane 70 to the outside surface 28 of the wall.

Figure 18:
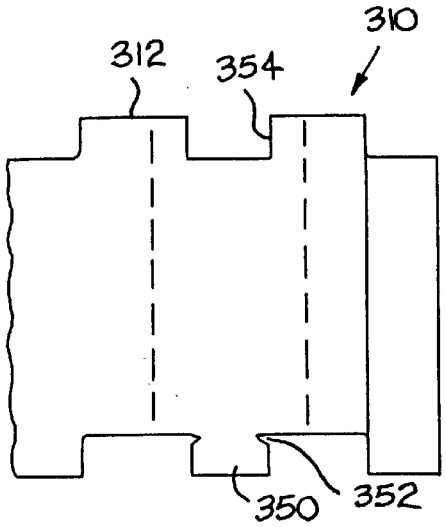
FIG. 18 is a side view of an alternative embodiment of a basic block, which may be used if there are problems with the blocks sagging during the manufacturing process.
Figure 19:
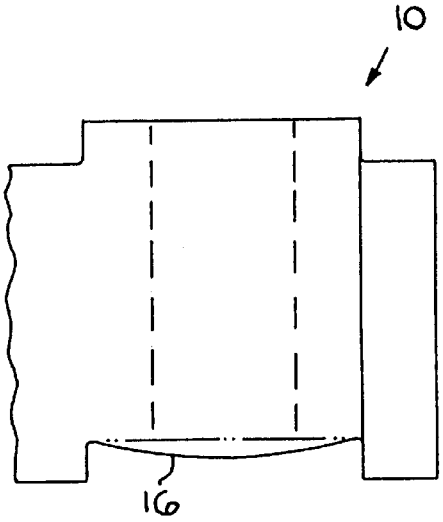
FIG. 19 is a side view showing a problem that might occur in the manufacture of the block of FIG. 1.
Figure 21:
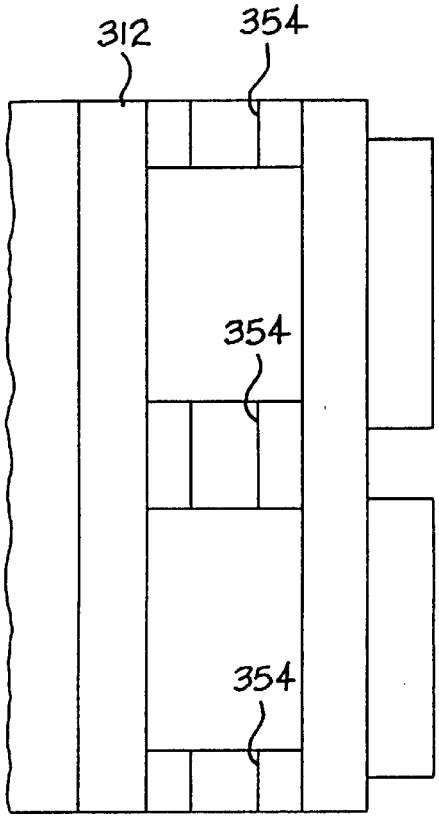
FIG. 21 is a top view of the block of FIG. 18.

In order to manufacture these blocks, the concrete material is placed in a mold and is compressed and shaken to make them dense and to give them a form, and then the compressed blocks are removed from their molds and heated. It is possible that, during the manufacturing process, the blocks 10 of FIG. 1, may sag on the bottom 16, as shown in FIG. 19. If this becomes a problem, an alternative design shown in FIG. 18 may be used. The block 310 of FIG. 18 is identical to the block 10 of FIG. 1, except that it includes a central projection 350 extending along its bottom surface, which supports the block 310 as it is being heated, to prevent the block 310 from sagging. The projection 350 defines notches 352 where it connects to the main block 312 (corresponding to the rectangular block portion 12 in FIG. 1), so that the central projection 350 may readily be knocked off of the block 310 after the block 310 has been made, if desired. There is a corresponding indentation 354 in the top surface of the block 310, as shown in FIGS. 18 and 21, which receives the central projection 350 of an identical block 310.

Figure 20:
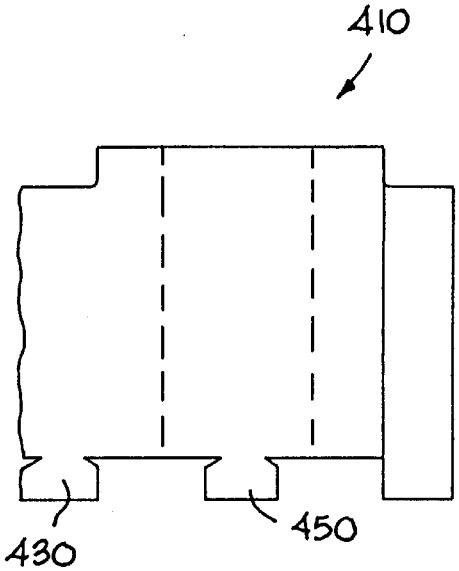
FIG. 20 is a side view of an alternative embodiment of a basic block that would both solve the sagging problem and form a horizontal-groove-forming block.

FIG. 20 shows still another alternative embodiment of a basic block which includes a notched central projection 450 and a notched front projection 430, which corresponds to the projection 30 on the block 10 of FIG. 1. With the front projection 430 being notched, it can also be removed from the finished block 410 if desired, so that this block 410 may be used either as a standard block, corresponding to the block 10 of FIG. 1, or, if the front projection 430 is removed, it can serve as a horizontal groove-producing block, corresponding to the block 110 of FIG. 5. This would reduce tooling costs and may be desirable at least in the first phase of production of the blocks.

Thus, the present invention provides blocks which can be formed into a wall using less skilled labor than standard blocks and which, when assembled, form a wall that is stronger and more resistant to wind and earthquake than prior art designs.

It will be obvious to those skilled in the art that modifications may be made to the embodiments described above without departing from the scope of the present invention.

What is claimed is:

1. A building block, comprising:

a substantially rectangular block portion, defining substantially flat top and bottom surfaces, and substantially flat left and right ends;

a front face, integral with said rectangular block portion, recessed from the top surface of said rectangular block portion by a predetermined height, and projecting downwardly beyond the bottom surface of said rectangular block portion by essentially the same predetermined height; and a rear face integral with said rectangular block portion, recessed from the top surface of said rectangular block portion, and recessed from the left and right ends of said rectangular block portion.

2. A building block, comprising:

a substantially rectangular block portion, defining substantially flat top and bottom surfaces, and substantially flat left and right ends;

a front face, integral with said rectangular block portion, recessed from the top surface of said rectangular block portion, and projecting downwardly beyond the bottom surface of said rectangular block portion; and a rear face integral with said rectangular block portion, defining a bottom edge that is flush with the bottom surface of said rectangular block portion, and being recessed from the top surface of said rectangular block portion, and recessed from the left and right ends of said rectangular block portion.

3. A building block, as recited in claim 1, wherein said rear face projects downwardly beyond the bottom surface of said rectangular block portion.

4. A building block, comprising:

a substantially rectangular block portion, defining substantially flat top and bottom surfaces, and substantially flat left and right ends;

a front face, integral with said rectangular block portion, recessed from the top surface of said rectangular block portion, and projecting downwardly beyond the bottom surface of said rectangular block portion; and a rear face integral with said rectangular block portion, recessed from the top surface of said rectangular block portion, and recessed from the left and right ends of said rectangular block portion, and defining a central vertical groove.

5. A block wall, comprising a plurality of building blocks stacked in rows on top of each other, with caulk between the blocks adhering the blocks together and forming a watertight gasket, each of said blocks including:

a substantially rectangular block portion, defining substantially flat top and bottom surfaces, and substantially flat left and right ends;

a front face, integral with said rectangular block portion; recessed from the top surface of said rectangular block portion, and projecting downwardly beyond the bottom surface of said rectangular block portion; and a rear face integral with said rectangular block portion, recessed from the top surface of said rectangular block portion, and recessed from the left and right ends of said rectangular block portion and defining a central vertical groove;

wherein the side recesses of one row of blocks are vertically aligned with corresponding central vertical grooves of the next row of blocks to form a continuous vertical groove, and wherein the projections of the front face portions of one row of blocks are received by the recesses of the front face portions of the next row of blocks; and wherein the upper surface of the rectangular block portion of one row of blocks abuts the lower surface of the rectangular block portions of the next row of blocks.

6. A block wall, as recited in claim 5, wherein the front face recess has an L-shaped cross-section, including a vertical back extending to the top surface, and the front face projection has an L-shaped cross-section, including a vertical back extending to the bottom surface.

7. A building block, comprising:

a substantially rectangular block portion, defining substantially flat top and bottom surfaces, and substantially flat left and right ends;

a front face, integral with said rectangular block portion, recessed from the top surface of said rectangular block portion, and projecting downwardly beyond the bottom surface of said rectangular block portion, said front face recess having an L-shaped cross-section, including a vertical back extending to the top surface, and said front face projection having an L-shaped cross-section, including a vertical back extending to the bottom surface; and a rear face integral with said rectangular block portion, recessed from the top surface of said rectangular block portion, and recessed from the left and right ends of said rectangular block portion.

8. A building block, as recited in claim 7, wherein said rear face projects downwardly beyond the bottom surface of said rectangular block portion.

9. A building block, as recited in claim 7, wherein said rear face defines a central vertical groove.

* * * * *